US009011189B2

(12) United States Patent
Tsukamoto

(10) Patent No.: US 9,011,189 B2
(45) Date of Patent: Apr. 21, 2015

(54) CHAIN TERMINAL

(75) Inventor: Masashi Tsukamoto, Kosai (JP)

(73) Assignee: Yazaki Corporation, Tokyo (JP)

( * ) Notice: Subject to any disclaimer, the term of this patent is extended or adjusted under 35 U.S.C. 154(b) by 36 days.

(21) Appl. No.: 13/822,814

(22) PCT Filed: Sep. 15, 2011

(86) PCT No.: PCT/JP2011/071146
§ 371 (c)(1),
(2), (4) Date: Mar. 13, 2013

(87) PCT Pub. No.: WO2012/036245
PCT Pub. Date: Mar. 22, 2012

(65) Prior Publication Data

US 2013/0183873 A1 Jul. 18, 2013

(30) Foreign Application Priority Data

Sep. 17, 2010 (JP) ..... 2010-209348

(51) Int. Cl.
*H01R 13/02* (2006.01)
*H01R 43/16* (2006.01)

(52) U.S. Cl.
CPC ..... *H01R 43/16* (2013.01)

(58) Field of Classification Search
CPC ..... H01R 43/16
USPC ..... 439/885
See application file for complete search history.

(56) References Cited

U.S. PATENT DOCUMENTS 4,395,087 A * 7/1983 Gorre et al. ..... 439/885
4,812,129 A 3/1989 Rofer et al.
4,904,539 A * 2/1990 Kling et al. ..... 428/572
5,957,739 A * 9/1999 Bianca et al. ..... 439/885
6,447,331 B1 * 9/2002 Fukatsu et al. ..... 439/516
6,620,002 B1 * 9/2003 Billman et al. ..... 439/885
8,640,333 B2 * 2/2014 Lyford et al. ..... 29/863
2013/0183873 A1 * 7/2013 Tsukamoto ..... 439/885

FOREIGN PATENT DOCUMENTS

CN 2410789 Y 12/2000
JP 58-51595 U 4/1983
JP 59-14282 A 1/1984

(Continued)

OTHER PUBLICATIONS

International Search Report (PCT/ISA/210), dated Nov. 1, 2011, issued by the International Searching Authority in counterpart International Patent Application No. PCT/JP2011/071146.

Written Opinion (PCT/ISA/237), dated Nov. 1, 2011, issued by the International Searching Authority in counterpart International Patent Application No. PCT/JP2011/071146.

(Continued)

*Primary Examiner* — Neil Abrams
(74) *Attorney, Agent, or Firm* — Sughrue Mion, PLLC

(57) ABSTRACT

A chain terminal is configured that a plurality of terminals are arranged in a chain shape by being connected to a side edge portion of a strip plate-shaped carrier through bridging sections respectively, and the terminals are configured to be cut and separated from the carrier when the bridging sections are cut out along a preset cutting line. Both side edges of each of the bridging sections are formed as slanted edges that are slanted with respect to lines respectively being perpendicular to the cutting line so that the width of each of the bridging sections at a terminal side is large and the width of each of the bridging sections at a carrier side is small.

3 Claims, 4 Drawing Sheets

(56) References Cited

FOREIGN PATENT DOCUMENTS

| | | | |
|---|---|---|---|
| JP | 64-45075 | A | 2/1989 |
| JP | 2-139883 | A | 5/1990 |
| JP | 5-41084 | U | 6/1993 |
| JP | 6-23172 | U | 3/1994 |
| JP | 2000-348838 | A | 12/2000 |
| JP | 2005-32516 | A | 2/2005 |

OTHER PUBLICATIONS

Office Action dated Nov. 3, 2014, issued by the Intellectual Property Office of P.R. China in counterpart Chinese Application No. 201180044828.1.

Final Rejection, Issued by the Japan Patent Office, Dated Nov. 11, 2014, in counterpart Japanese Application No. 2010-209348.

Communication from the Japanese Patent Office dated Aug. 12, 2014, in a counterpart Japanese application No. 2010-209348.

* cited by examiner

CHAIN TERMINAL

TECHNICAL FIELD

The present invention relates to a chain terminal which is configured such that a plurality of terminals are connected to a side edge portion of a strip plate-shaped carrier via respective bridging sections.

BACKGROUND ART

A chain terminal which is configured such that a plurality of terminals are formed in a chain shape to be integrally formed with a carrier and each of the terminals is to be cut and separated from the carrier when used in order to improve productivity or efficiency in delivery of the terminals, is widely known.

FIG. 3 is a plan view showing a structure of a related chain terminal described in, for example, Patent Document 1.

A chain terminal 21 is produced in such a manner that a strip plate-shaped material is formed in a predetermined shape by being subjected to a punching process by using a pressing machine. A plurality of terminals 22 are arranged in a chain shape at a side edge portion of a strip plate-shaped carrier 23. The terminals 22 are connected to the side edge portion of the carrier 23 via respective bridging sections 25. By cutting the bridging sections 25 along a preset cutting line S, the terminals 22 can be cut and separated from the carrier 23.

FIG. 4(*a*) shows a state that the chain terminals are cut at the bridging sections 25 and FIG. 4(*b*) shows a cut portion in an enlarged condition.

The bridging section 25 in the related chain terminal 21 is formed in a strip plate shape so as to have a predetermined width and to allow both side edges of the bridging section 25 to be in parallel to each other. When each of the bridging sections 25 is cut out along the cutting line S by using a cutting tool or the like, each of both corner portions 28 of a cut end 27 has a sharp edge having a roughly right angle. In a case where the edges each having a sharp angle are produced on the cut end 27 of the bridging section 25 as described in the above, when, for example, the terminal is used in a peeled condition as a ground terminal or the like, the edge may possibly cause an electric wire or the like to be damaged.

PRIOR ART DOCUMENTS

Patent Documents

Patent Document 1: JP-A-2000-348838

SUMMARY OF INVENTION

Problems that the Invention is to Solve

As described in the above, regarding the related chain terminal 21, in a case where the bridging section 25 connecting the terminal 22 to the carrier 23 is cut out and the terminal 22 is cut and separated from the carrier 23, a sharp edge is produced at each of both corner portions 28 of the cut end 27 of the bridging section 25 so that the sharp edge may possibly cause an electric wire or the like to be damaged.

In view of the above circumstance, the purpose of the invention is to provide a chain terminal that can prevent a sharp edge from being formed at a cut end of a bridging section, and thereby reduce a risk of damaging an electric wire or the like.

Means for Solving the Problems

The above purpose of the invention can be achieved by the following constitutions.

(1) A chain terminal is configured that a plurality of terminals are arranged in a chain shape by being connected to a side edge portion of a strip plate-shaped carrier through bridging sections respectively, and the terminals are configured to be cut and separated from the carrier when the bridging sections are cut out along a preset cutting line. Both side edges of each of the bridging sections are formed as slanted edges that are slanted with respect to lines respectively being perpendicular to the cutting line so that the width of each of the bridging sections at a terminal side is large and the width of each of the bridging sections at a carrier side is small.

(2) The chain terminal having the constitution of the above item (1) is further configured that each of the slanted edges is slanted to an angle close to a portion taken along the cutting line.

In accordance with the above described item (1), the both side edges of each of the bridging sections are formed as the slanted edges that are slanted with respect to lines perpendicular to the cutting line respectively. Therefore, in a case where each of the bridging sections is cut out in order to cut and separate the terminals from the carrier, angles of both corner portions of the cutting edge can be obtuse angles which are larger than a right angle. For this reason, even when an edge is formed on the corner portion, the angle of the edge can be made to be an obtuse angle lager than a right angle so that it is possible to reduce a risk of damaging an electric wire or the like, and thereby it is possible to enhance the safety.

In accordance with the above described item (2), since each of the slanted edge is slanted to an angle close to a portion taken along the cutting line, the angles of the both corner sections of the cut end can be an obtuse angle close to 180 degrees. Therefore, it is possible to further enhance the safety of the cut end.

MODE FOR CARRYING OUT THE INVENTION

A chain terminal according to an embodiment of the invention will be described below with reference to the accompanying drawings.

Figure 1A:
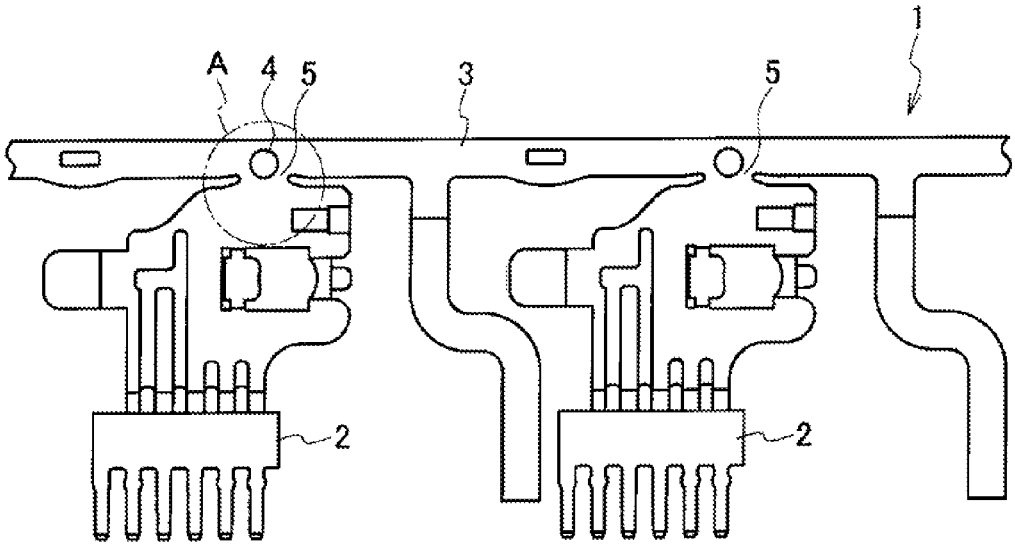
FIG. 1(*a*) is a plan view showing a state that terminals of a chain terminal according to an embodiment of the invention are not yet cut nor separated, and FIG. 1(*b*) is an enlarged view showing a part within a circle A in FIG. 1(*a*).
Figure 1B:
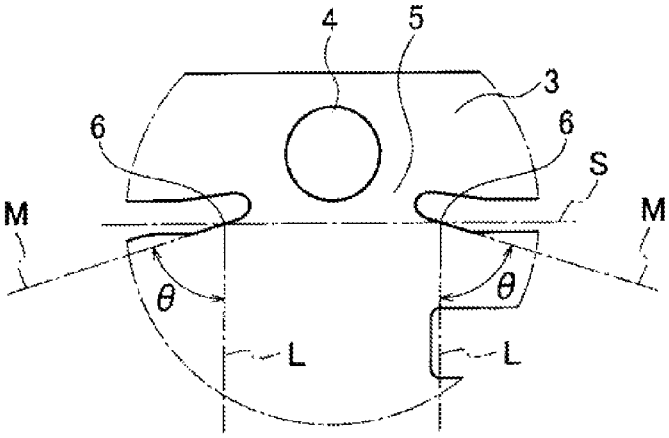
Figure 2A:
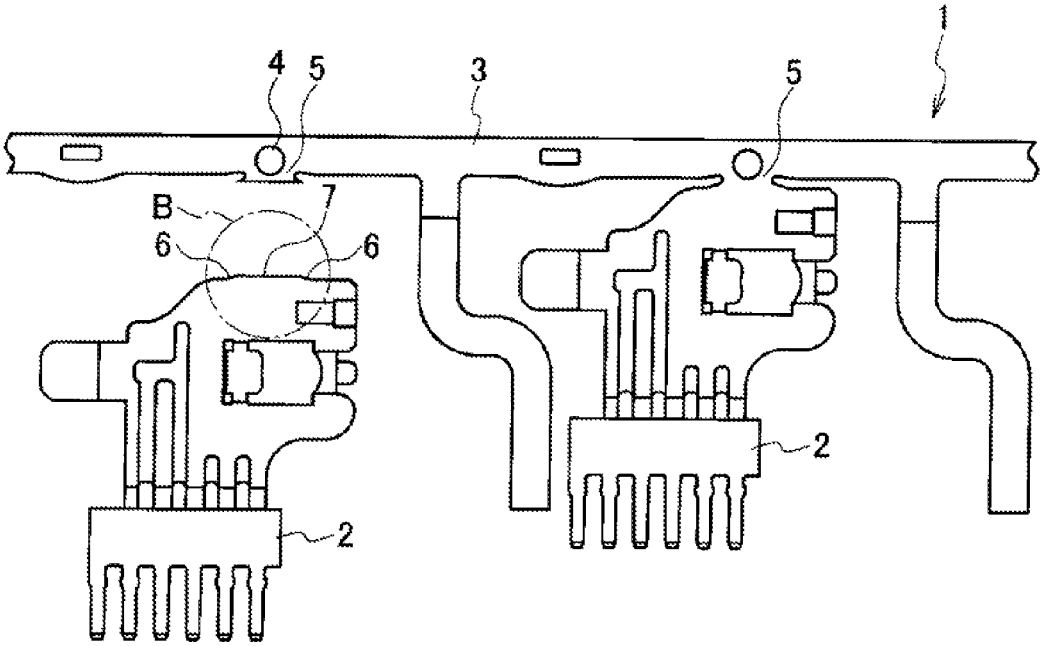
FIG. 2(*a*) is a plan view showing a state that a bridging section of the chain terminal shown in FIG. 1(*a*) is cut out, and FIG. 2(*b*) is an enlarged view showing a part within a circle B in FIG. 2(*a*).
Figure 2B:
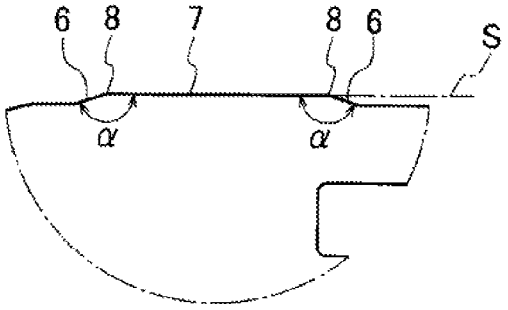
Figure 3:
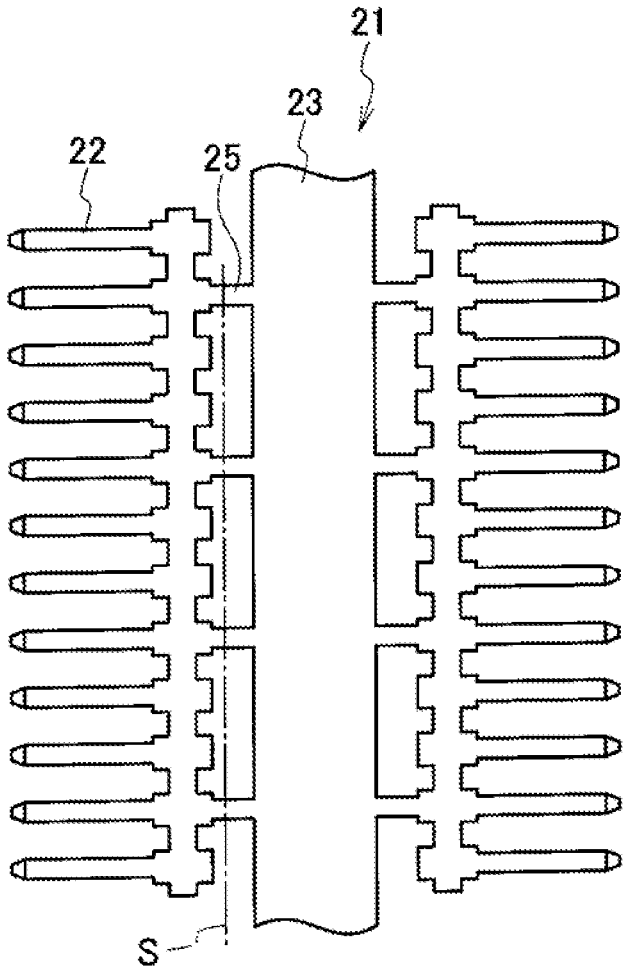
FIG.3 PRIOR ART
FIG. 3 is a plan view showing a constitution of a related chain terminal.
Figure 4A:
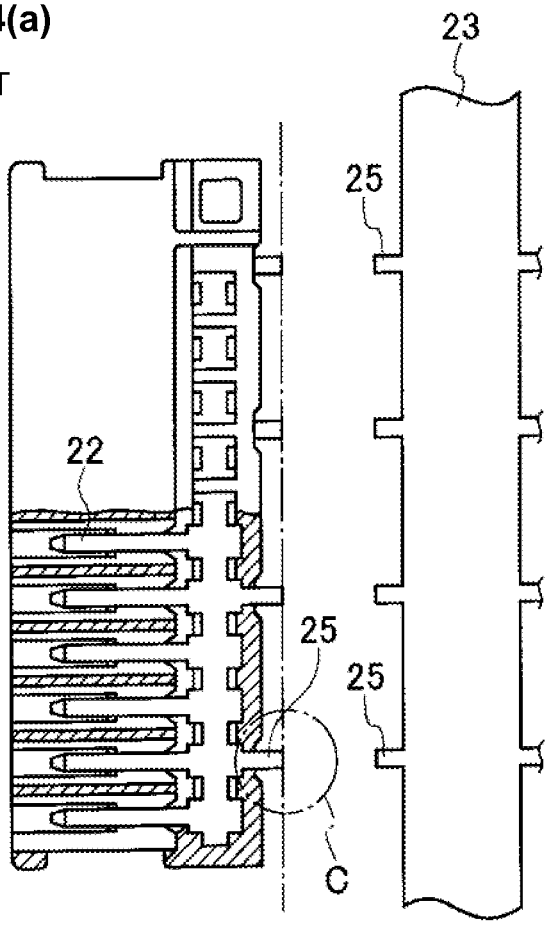
FIG.4(a) PRIOR ART
FIG. 4(*a*) is a plan view showing a state that a bridging section of the related chain terminal shown in FIG. 3 is cut out, and FIG. 4(*b*) is an enlarged view showing a part within a circle C in FIG. 4(*a*).
Figure 4B:
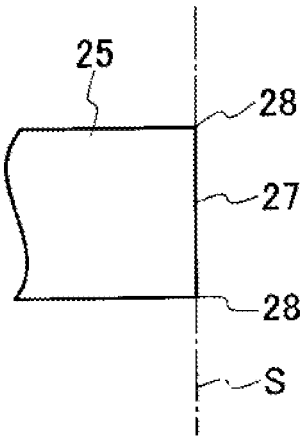
FIG. 4(b) PRIOR ART

FIGS. 1(*a*) and 1(*b*) are schematic views showing a state that terminals of the chain terminal according to an embodiment of the invention are not yet cut nor separated, and FIGS. 2(*a*) and 2(*b*) are schematic views showing a state that bridging sections of the chain terminal are cut out.

The chain terminal 1 of the embodiment is produced in such a manner that a strip plate-shaped material is formed in a predetermined shape by being subjected to a punching process by using a pressing machine. A plurality of terminals 2 are arranged in a chain shape at a side edge portion of a strip plate-shaped carrier 3. The terminals 2 are connected to the side edge portion of the carrier 3 via bridging sections 5 respectively. Each of the terminals is to be cut and separated from the carrier 3 when the bridging sections 5 are cut out along a preset cutting line S.

Pilot holes 4 are provided on the carrier 3 at a predetermined interval, and then a strip plate forming the chain terminal 1 can be regularly and intermittently transported to a pressing device by using the pilot holes 4. Thereby, a predetermined pressing process can be applied to the strip plate by means of the pressing device under a condition that the transporting is stopped.

In addition, the chain terminal 1 is configured such that both side edges of each of the bridging sections 5 are formed as slanted edges 6 that are slanted by an angle θ with respect to lines L respectively being perpendicular to the cutting line S so that the width of each of the bridging section 5 at a terminal 2 side is large and the width of each of the bridging section 5 at a carrier 3 side is small. Particularly, in the embodiment, the slanted edge 6 is slanted to an angle (θ=approximately 70° to 80°) close to a portion taken along the cutting line S. Incidentally, in FIG. 1(*b*), lines indicated by symbols M are extension lines of the slanted edge 6 and the angle θ is defined as an angle formed between the line M and the line L.

In the chain terminal 1 constituted as described above, when the bridging sections 25 are cut out along the cutting line S by a cutting tool or the like, each of the angles α of the both corners 8 of the cut end 7 can be made to be an obtuse angle larger than a right angle as shown in FIG. 2(*b*). Particularly, since the slanted edge 6 is slanted to the angle close to the portion taken along the cutting line S in the embodiment, each of the angles α of the both corners 8 of the cut end 7 can be made to be an obtuse angle close to 180 degrees. Therefore, an edge is hardly formed on the cut end 7 so that it is possible to reduce a risk of damaging an electric wire or the like, and thereby it is possible to enhance the safety.

Meanwhile, the embodiment described above is only a representative embodiment of the invention, and the invention is not limited to the above embodiment. That is, various changes can be made without departing from the essence of the invention. This application is based on Japanese Patent Application (JP-2010-209348) filed on Sep. 17, 2010, the contents of which are incorporated herein by reference.

INDUSTRIAL APPLICABILITY

In accordance with the chain terminal according to the invention, sharp edges are not formed on the cut end of the bridging section, and thereby it is possible to reduce a risk of damaging an electric wire or the like, and thereby it is possible to enhance the safety.

DESCRIPTION OF REFERENCE NUMERALS AND SIGNS

1 chain terminal
2 terminal
3 carrier
5 bridging section
6 slanted edge
7 cut end
S cutting line

The invention claimed is:

1. A chain terminal being configured that a plurality of terminals are arranged in a chain shape by being connected to a side edge portion of a strip plate-shaped carrier through bridging sections respectively, and the terminals are configured to be cut and separated from the carrier when the bridging sections are cut out along a preset cutting line, wherein both side edges of each of the bridging sections are formed as slanted edges that are slanted with respect to lines respectively being perpendicular to the cutting line so that the width of each of the bridging sections at a terminal side is largest and the width of each of the bridging sections at a carrier side is smallest;

wherein the cutting line is set so as to cross the slanted edges such that the cutting line is displaced from each of the smallest width bridging sections located at a carrier side.

2. The chain terminal according to claim 1, wherein each of the slanted edge is slanted to an angle close to a portion taken along the cutting line.

3. The chain terminal according to claim 1, wherein each of the slanted edges is slanted to the portion taken along the cutting line so that each angle of both corners of a cut end form an obtuse angle close to 180 degrees.

* * * * *